3/8/88 XR 4,729,303

United States Patent [19]

Durbin

[11] Patent Number: 4,729,303

[45] Date of Patent: Mar. 8, 1988

[54] AIRCRAFT TRASH COMPACTOR WITH PENETRATION RESISTING LINER

[75] Inventor: James L. Durbin, Valencia, Calif.

[73] Assignee: A.K.G.S., Las Vegas, Nev.

[21] Appl. No.: 900,704

[22] Filed: Aug. 27, 1986

[51] Int. Cl.[4] ..... B30B 15/04

[52] U.S. Cl. ..... 100/214; 100/229 A; 100/299; 428/116; 428/911

[58] Field of Search ..... 2/2.5; 139/425 R; 428/902, 911, 116; 100/215, 229 A, 240, 214, 299, 211; 51/257; 156/192, 307.1

[56] References Cited

U.S. PATENT DOCUMENTS

| | | | |
|---|---|---|---|
| 3,879,244 | 4/1975 | Varlas | 156/192 |
| 4,152,035 | 5/1979 | Fox | 100/215 X |
| 4,401,499 | 8/1983 | Kaneko et al. | 156/307.1 X |
| 4,529,640 | 7/1985 | Brown et al. | 428/116 |
| 4,531,354 | 7/1985 | Zentner et al. | 57/257 X |
| 4,613,535 | 9/1986 | Harpell et al. | 2/2.5 X |
| 4,637,511 | 1/1987 | Johnson et al. | 139/425 R |

*Primary Examiner*—Andrew M. Falik

*Attorney, Agent, or Firm*—Fulwider, Patton, Rieber, Lee & Utecht

[57] ABSTRACT

An improved lightweight aircraft or aerospace trash compactor having a nonmetallic, penetration-resistant lining for the compacting chamber. The lining is a nonmetallic, high strength fabric, such as aramid, graphite, or mixtures, thereof which is impregnated with a thermosetting resin such as epoxy resin.

7 Claims, 4 Drawing Figures

AIRCRAFT TRASH COMPACTOR WITH PENETRATION RESISTING LINER

BACKGROUND OF THE INVENTION

This invention generally relates to trash compactor systems and particularly to trash compactor systems for aircraft or aerospace vehicles.

The handling of large amounts of waste material generated during the flight of passenger-carrying aircraft has long presented a major problem to in-flight service personnel. The introduction of wide-bodied jet aircraft with very high density passenger configurations has exacerbated the problem, not only from an in-flight service point of view but also with respect to flight safety. Current methods of waste disposal on board passenger-carrying aircraft include the use of paperboard boxes and plastic bags in conjunction with trash bins or trash carts which require high volume storage areas. Frequently, when the primary trash storage areas are filled, plastic bags or paper bags with plastic inserts are used to collect excess trash. These excess trash containers are frequently stored during the flight in the galley areas or in lavatories, thereby rendering them unusable for passengers, and even behind the last row of passenger seats or in unused passenger seats. Such filled trash containers are not only unsightly, but they also present a serious risk of on-board fire due to the highly combustible nature of the trash and the possibility that ignition sources may have been introduced into the container along with the trash. An additional safety hazard is created when excess filled trash containers are stored in exit areas because these containers may block or impede egress in emergency situations.

During a typical five-hour flight with statistically average passenger loads on wide-bodied aircraft (e.g., from Hawaii to California or across the continental United States), approximately 20 to 30 cubic feet of trash may be generated. On longer transoceanic routes lasting up to 15 hours, 80 to 120 cubic feet of trash may be generated due to the number of meal, snack, and bar services that are offered.

The trash compactors now available for residential uses are incapable of handling the large volumes of trash generated on board an aircraft within the time constraints for in-flight service. They have neither the power, the space saving capability, nor the cycle time sufficient to meet the in-flight service requirements.

For trash compactors to be used on aircraft, they have to be placed within the galley of the aircraft, or in an easily accessible processing location, such as a closet, or have to be fitted onto rolling carts of the same or similar size as the food and beverage carts used on the aircraft. Thus, such compactors would have to be relatively small, lightweight, and be custom configured to fit in the many appropriate installation locations aboard aircraft and space vehicles. Commercial or industrial trash compactors now available are much too large and heavy for such uses, and they require electrical power not ordinarily available on the aircraft.

During the initial development of trash compactors for aircraft, the present assignees believed that sheet metal panels for the compacting chamber were not desirable because of the added weight. However, available lightweight nonmetallic panels were not found to be very suitable. It was found that the higher compacting pressures applied to the trash by aircraft compactors could drive sharp pointed objects, such as broken glass bottles, through the nonmetallic panels. The damage to the panel would be particularly severe with a low angle of attack toward the panel surface by the pointed object. Such penetration would cause long slashes in the panel thereby structurally weakening the panel so it could no longer properly support the trash container during the compaction of trash thereon.

What has been heretofore unavailable is a trash compactor with lightweight compacting chamber wall which will not be damaged by sharp pointed objects during high pressure trash compaction. The present invention satisfies this need and provides further related advantages.

SUMMARY OF THE INVENTION

This invention is directed to an improved trash compactor and particularly to a lightweight aircraft trash compactor which utilizes high compacting pressures.

The trash compactor of the invention generally comprises a cabinet having an interior compacting chamber defined in part by a floor and four upstanding walls. Also included is a compactor platen or ram and extendible means to drive the platen from a position in the upper portion of the compacting chamber toward the floor thereof during compaction and to withdraw the compacting platen back into the upper portion of the chamber upon completion of the compacting.

In accordance with the invention, the walls and preferably the flooring are provided with a penetration resistant surface comprising one or more layers of a fabric formed from high strength fiber such as aromatic amide (aramide) or graphite which is impregnated with a thermosetting plastic such as epoxy resins.

Preferably, the surface is a multilayered product of up to ten plies of a woven aramid fabric which has been impregnated with an epoxy resin, such as bisphenol A, and novolac epoxy resins. Urea and amide type curing agents are preferred.

In a preferred embodiment, the walls and flooring are panels with a honeycomb core having the multiple ply, epoxy impregnated aramid fabric secured thereto.

The amount of aramid or graphite fiber in the fabric should range from about 25 percent to about 65 percent (by weight) and preferably 30 to 60 percent and the thermosetting resins impregnated therein from about 30 percent to 60 percent (by weight), preferably 35 to 55 percent.

The uncured, single ply thickness of the prepreg fabric is typically about 10 mils but may range from about 5 to 15 mils. The prepreg fabric is placed onto a supporting substrate such as an aluminum or titanium honeycomb core and cured at elevated temperatures. The epoxy resin forms a tenacious bond between the layers of fabric and with the substrate so there is little chance of delamination or pulling away from the core during use.

The protective chamber walls of the invention are lightweight, they prevent penetration of pointed objects, such as broken glass bottles and the like, and provide sufficient support to the trash container within the chamber during the compaction of trash therein.

These and other advantages of the invention will become more apparent from the following detailed description thereof when taken in conjunction with the accompanying exemplary drawings.

DETAILED DESCRIPTION OF THE DRAWINGS

Figure 1:
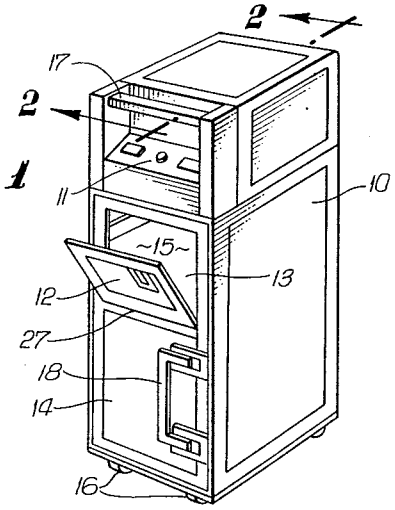
FIG. 1 is a perspective view of a trash compactor embodying features of the invention.

Reference is made to FIG. 1 which is a perspective view of a trash compactor embodying features of the invention. As shown in this figure, the compactor generally comprises a housing or cabinet 10 which has a control panel 11, a chute 12 for feeding trash into the interior compacting chamber 13 of the housing 10, and a door 14 in the front of the housing 10 for inserting and removing trash containers 15. The door 14 is provided with latches 18 for the opening and closing thereof. The particular embodiment shown in FIG. 1 is designed to be portable and is provided with wheels 16 on the lower portion thereof and with a handle 17 to facilitate moving the compactor to a desired location.

Figure 2:
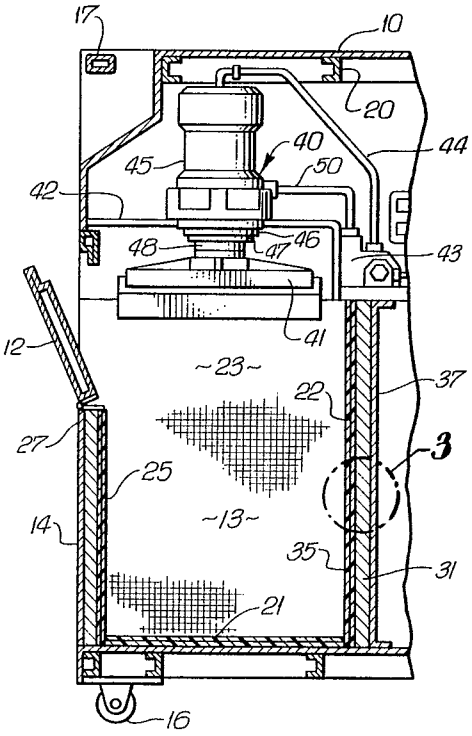
FIG. 2 is a cross-sectional view taken along lines 2—2 shown in FIG. 1.

FIG. 2 generally illustrates the interior of the compactor shown in FIG. 1. As shown, the compactor housing 10 generally includes a rigid frame 20 and a compacting chamber 13 within the housing 10 which is defined by a floor panel 21, a rear panel 22, side panels 23 and a front panel 25 which is secured to the inside of door 14.

Figure 4:
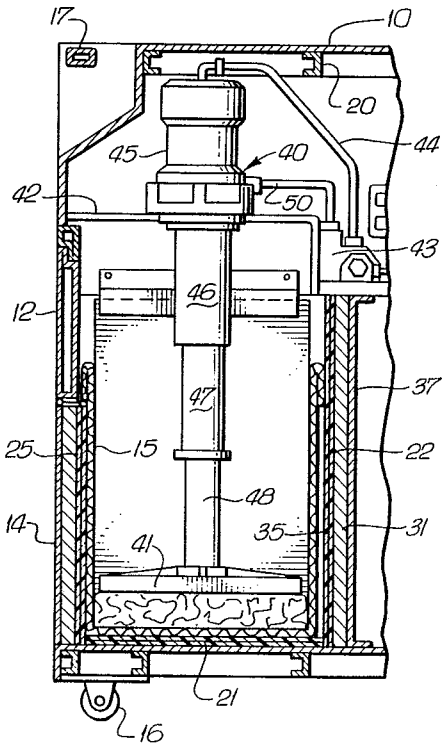
FIG. 4 is a cross section as shown in FIG. 2, with the ram assembly in an extended position.

The chute 12 is hingedly connected on the lower margin thereof to the front 27 of the housing 10 for feeding trash into a trash container 15 (as shown in FIG. 4) positioned within compacting chamber 13. Door 14 is pivotally mounted along a side margin thereof about a vertical axis by means of the hinges (not shown) in order to load and unload trash containers 15. Preferably, suitable electrical interlocks (not shown) are provided on the chute 12 and the door 14 to ensure that the compactor is inoperable unless both are closed.

Figure 3:
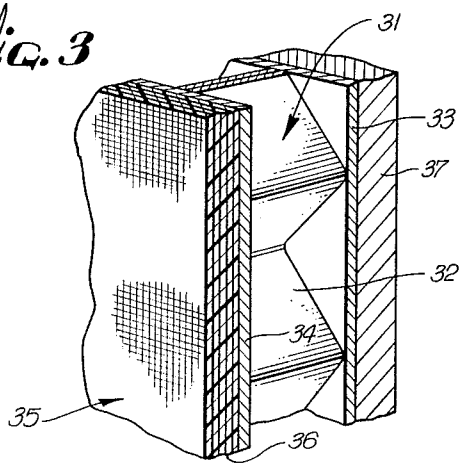
FIG. 3 is an enlarged view of the circle 3 shown in FIG. 2.

FIG. 3 illustrates a typical cross section of the panel 22 which forms the rear wall of the compacting chamber 13. It is typical of the panels 21, 23, 25 forming the walls and flooring of the chamber 13. The panel comprises a core 31 having a honeycomb section 32 of other light metals and facing plates 33 and 34 secured to opposing sides of the honeycomb section 32 and a composite layer 35 which forms the inside surface of the panel 22. The composite layer 35 is formed from a plurality of layers or plies 36 of fabric or webbing formed from a high-strength non-metallic fiber such as an aromatic amide (aramid) or graphite which are impregnated with a thermosetting plastic material, preferably an epoxy resin. One or more layers 36 of the prepreg fabric are cured on the core 31 and form a tenacious bond thereto and between the individual layers 36. The panels for the side and rear walls of the chamber 13 are supported by suitable means such as angle or I beams 37.

The preferred composite material is an aramid fabric Kevlar® 49 which is impregnated with a mixture of bisphenol A epoxy resin, brominated bisphenol A epoxy resin, and novolac epoxy resin cured at 250° F. The curing agents incorporated into the resins include dicyandiamide and 3-(3,4-dichlorophenyl)-1,1-dimethylurea. Other components include elastomeric modifiers and flame retardants. The amount of Kevlar® 49 fibers range from about 35 to 55% (by weight and the epoxy resins from about 40 to 50% (by weight). A suitable material is a prepreg fabric sold by the Fiberite Corporation under the product identification MXM 2714/285.

The composite panel of the invention is very strong, lightweight and provides a high resistance to penetration by sharp edged objects which may be pressed against the panel during the trash compaction process. In the preferred embodiment, the entire exposed surface of the panel is formed from a single layer of prepared fabric so that there are no seams on the inner surface of the compacting chamber which may catch sharp pointed objects during trash compaction. Preferably, the front, back, sidewalls, and the floor of the compacting chamber are provided with the composite panels to minimize the use of metal which can add considerably to the weight of the compactor.

The operational elements of the compactor generally comprise a compacting ram drive assembly 40, having a ram 41 fixed to the one end thereof, which is supported at the other end thereof from the cross member 42 of interior frame 20 in the upper portion of the compactor interior. The ram drive assembly 40 is operated by high pressure hydraulic fluid, and a control valve system 43 therefor directs the hydraulic fluid through conduit 44 to the ram drive assembly 40 and other portions of the compactor to control the operation thereof.

The ram drive assembly 40 comprises a head section 45 which is fixed to cross member 42 and the interfitting telescoping sections 46, 47, and 48. High pressure hydraulic fluid is initially directed from control valve system 43 through line 44 to the head section 45 of the ram drive assembly 40. The high pressure fluid fills up inner chamber thereof causing the telescoping sections 46–48 to extend in sequence. When the hydraulic pressure acting on the top of section 48 provides a compacting pressure exceeding a predetermined maximum, the control valve system 43 terminates the flow of high pressure fluid through line 44 and puts the ram drive assembly line 44 in communication with a reservoir (not shown) thereby stopping the downward movement of the ram 41. Simultaneously, the control valve system 43 redirects the high pressure fluid flow through line 50 to cause sections 46–48 to retract.

Further details of the trash compactor and the operation thereof are described in copending applications Ser. Nos. 781,391, 4,620,479 filed Sept. 26, 1985; 868,131, filed May 28, 1986; and 889,685, filed July 24, 1986, assigned to the present assignee which are hereby incorporated by reference in their entirety.

Various modifications and improvements can be made to the present invention. For example, various components can be incorporated into the impregnated resin to improve various properties thereof. Other fiber components can also be added to the fabric to modify the properties thereof. Other modifications and improvements can be made without departing from the scope thereof.

What is claimed is:

1. A lightweight high pressure trash compactor comprising:

(a) a cabinet with an internal compacting chamber defined by a floor, upstanding walls, and an upper portion thereof and being adapted to receive a trash container;

(b) a compacting platen disposed within the upper portion of the compacting chamber;

(c) extendible means to drive the compacting platen downwardly toward the floor of the compacting chamber and to withdraw the compacting platen into the upper portion of the compacting chamber; and (d) a substantially impenetrable fabric formed of high strength, nonmetallic fiber impregnated with a thermosetting resin secured to inner surfaces of the internal compacting chamber.

2. The trash compactor of claim 1 wherein the thermosetting resin consists essentially of epoxy resin.

3. The trash compactor of claim 2 wherein the epoxy resin is selected from the group consisting of a bisphenol A epoxy resin, a bisphenol A brominated epoxy resin, a novolac epoxy resin and mixtures thereof.

4. The trash compactor of claim 1 wherein the high strength fibers are selected from the group consisting of aramid fibers, graphite fibers, and mixtures thereof.

5. The trash compactor of claim 4 wherein the impenetrable fabric comprises from about 25% to about 65% aramid fibers and from about 30% to about 60% epoxy resin.

6. The trash compactor of claim 1 wherein at least the upstanding walls include a lightweight core and have the substantially impenetrable fabric secured to the inside surface thereof.

7. The trash compactor of claim 6 wherein the lightweight core is a honeycomb structure formed from a material selected from the group consisting of aluminum, titanium and alloys thereof.

* * * * *